US008579679B2

(12) United States Patent
Fukushima et al.

(10) Patent No.: US 8,579,679 B2
(45) Date of Patent: Nov. 12, 2013

(54) CONDITIONING METHOD AND CONDITIONING APPARATUS FOR POLISHING PAD FOR USE IN DOUBLE SIDE POLISHING DEVICE

(75) Inventors: Hiroto Fukushima, Tokyo (JP); Tomonori Miura, Tokyo (JP); Yasuhiko Tsukanaka, Kashiwara (JP); Takeshi Ezaki, Kashiwara (JP)

(73) Assignee: Sumco Corporation, Tokyo (JP)

( * ) Notice: Subject to any disclaimer, the term of this patent is extended or adjusted under 35 U.S.C. 154(b) by 411 days.

(21) Appl. No.: 12/880,471

(22) Filed: Sep. 13, 2010

(65) Prior Publication Data

US 2011/0065365 A1 Mar. 17, 2011

(30) Foreign Application Priority Data

Sep. 15, 2009 (JP) ..... 2009-213308

(51) Int. Cl.
*B24B 1/00* (2006.01)

(52) U.S. Cl.
USPC ..... 451/56; 451/63; 451/283; 451/285; 451/290; 451/443

(58) Field of Classification Search
USPC ..... 451/56, 57, 58, 63, 283, 285, 287, 290, 451/443
See application file for complete search history.

(56) References Cited

U.S. PATENT DOCUMENTS 4,984,390 A * 1/1991 Kobayashi ..... 451/443
5,421,768 A * 6/1995 Fujiwara et al. ..... 451/283
6,390,909 B2 * 5/2002 Foster et al. ..... 451/444
6,688,957 B2 * 2/2004 Tolles ..... 451/532
8,257,150 B2 * 9/2012 Fujita ..... 451/56
2001/0041527 A1 * 11/2001 Foster et al. ..... 451/444
2002/0164928 A1 * 11/2002 Tolles ..... 451/41
2011/0312254 A1 * 12/2011 Koyama ..... 451/56

FOREIGN PATENT DOCUMENTS

JP 07-009342 1/1995

* cited by examiner

*Primary Examiner* — Eileen P. Morgan
(74) *Attorney, Agent, or Firm* — Thomas J Engellenner; Reza Mollaaghabaha; Pepper Hamilton LLP

(57) ABSTRACT

The present invention provides an apparatus capable of uniformly grinding an polishing pad. Further, the present invention provides a method of grinding an polishing pad by using the grinding apparatus. Specifically, the present invention provides a method of, in a double-side polishing device having a carrier for holding a work, a pair of upper and lower rotating surface plates disposed to face each other to sandwich the carrier therebetween, and the polishing pad provided on each of the facing surfaces of the rotating surface plates for polishing the work, grinding the polishing pad, the method comprising the steps of: separating the upper and the lower rotating surface plates away from each other when the polishing pads on the upper and the lower rotating surface plates are to be ground; inserting, between the separated upper and lower rotating surface plates, an arm having at a front end portion thereof a grinding plate of a diameter smaller than those of the rotating surface plates; and pressing the grinding plate against the polishing pad of each of the rotating surface plates and rotating the grinding plate, thereby grinding the polishing pad of each of the rotating surface plates. The present invention also provides an apparatus which enables the grinding method described above.

11 Claims, 6 Drawing Sheets

CONDITIONING METHOD AND CONDITIONING APPARATUS FOR POLISHING PAD FOR USE IN DOUBLE SIDE POLISHING DEVICE

BACKGROUND OF THE INVENTION

1. Field of the Invention

The present invention relates to a method of, in a double-side polishing device that polishes by using a polishing pad both sides of a work to be polished such as a wafer or a compact disk which is required to have a mirror-finished surface as well as uniform thickness, grinding (also known as conditioning) the polishing pad that has been clogged with polishing powder and the like after polishing, and, in particular, to a method that can easily grind (condition) the polishing pad. Additionally, the present invention relates to a grinding (conditioning) apparatus which is capable of realizing such a grinding (conditioning) method as described above.

2. Description of Related Art

A wafer is exemplarily shown as a subject to be polished for which uniform thickness and mirror-finished surfaces are required. Both sides of a wafer obtained by thinly cutting single crystal silicon need be precisely mirror-finished and polished to have uniform thickness before semiconductor circuits are formed thereon. For this purpose, as shown in JP 07-009342 Laid-Open, by using a double-side polishing device, a carrier that holds a wafer is sandwiched between an upper and a lower rotating surface plates each having an polishing pad such as felt, while an alkaline solution containing abrasive grains such as silica microparticles is supplied to the polishing pad, and the upper and the lower rotating surface plates are rotated, so that both sides of the wafer are polished to be in a mirror-surface state.

However, in a case where the polishing process is repeated, the polishing pad is impregnated and clogged with a slurry-like product formed by the polishing agent and particles dissociated from the wafer through polishing process, whereby the deterioration of polishing ability of the polishing pad is resulted.

As a method of solving such a problem as described above, JP 07-009342 discloses a cleaning method, comprising the steps of: pressing a grinding plate having diamond or ceramic pellets coated thereon against an polishing pad and rotating the grinding plate, to grind the polishing pad and remove a product of a polishing agent and dissociated wafer particles; and then spraying highly pressurized purified water from a nozzle onto a polished surface of the polishing pad during the polishing operation, to purge the products remaining in a deeper layer of the polishing pad out by an impact of the spraying.

According to the grinding method of JP 07-009342, a grinding plate having a diameter equal to or larger than those of the rotating surface plates is sandwiched between an upper and a lower rotating surface plates and the grinding plate and the rotating surface plates are rotated relative to each other to grind the polishing pad. However, since the degree of clogging with the slurry-like product varies depending on the areas of the polishing pad, there is a possibility that the surface of the polishing pad fails to be uniformly ground after the grinding process by using the grinding plate of JP 07-009342. Consequently, the polishing pad may not be regenerated to an polishing pad having uniform quality after the cleaning process with liquid thereafter and thus polishing of a work surface may not be implemented with high precision.

SUMMARY OF THE INVENTION

In view of the circumstances described above, an object of the present invention is to provide a grinding (also known as conditioning) apparatus that can grind (condition) a polishing pad uniformly. Further, another object of the present invention is to provide a method of grinding (conditioning) a polishing pad by using the grinding (conditioning) apparatus.

In order to achieve the object above, a first aspect of the present invention provides a method of, in a double-side polishing device having a carrier for holding a work, a pair of upper and lower rotating surface plates disposed to face each other to sandwich the carrier therebetween, and the polishing pad provided on each of the facing surfaces of the rotating surface plates for polishing the work, grinding the polishing pad, the method comprising the steps of: separating the upper and the lower rotating surface plates away from each other when the polishing pads on the upper and the lower rotating surface plates are to be ground; inserting, between the separated upper and lower rotating surface plates, an arm having at a front end portion thereof a grinding plate of a diameter smaller than those of the rotating surface plates; and pressing the grinding plate against the polishing pad of each of the rotating surface plates and rotating the grinding plate, thereby grinding the polishing pad of each of the rotating surface plates.

It is preferable that the aforementioned method of the first aspect of the present invention further comprises, in a case where the upper rotating surface plate is coupled with a rotational axis having a floating mechanism, first fixing the upper rotating surface plate and then pressing a rough surface of the grinding plate against the polishing pad of the upper rotating surface plate and rotating the grinding plate, thereby grinding the polishing pad of the upper rotating surface plate.

A second aspect of the present invention provides an apparatus for use in a double-side polishing device having a carrier for holding a work, a pair of upper and lower rotating surface plates disposed to face each other to sandwich the carrier therebetween, and an polishing pad provided on each of the facing surfaces of the rotating surface plates for polishing the work, said apparatus being adapted to grind the polishing pads of the upper and lower rotating surface plates, said apparatus comprising:

an arm: having at a front end thereof at least one grinding plate each provided with a rough surface of a diameter smaller than those of the rotating surface plates; and adapted to be capable of advancing/retracting between the upper and the lower rotating surface plates spaced apart from each other, moving upward and downward between the upper and the lower rotating surface plates, and moving to place the grinding plate on each of the polishing pads such that the grinding plate grinds the entire area of the polishing pad.

Further, in the aforementioned apparatus of the second aspect of the present invention, it is preferable that the upper rotating surface plate is coupled with a rotational axis having a floating mechanism and that the device further comprises a fixing means for fixing the upper rotating surface plate with respect to the floating mechanism. In the present invention, the expression of "fixing the upper rotating surface plate with respect to the floating mechanism" means that the upper rotating surface plate is fixed so as not to float or resiliently move with respect to the work.

Yet further, in the second aspect of the present invention, it is preferable that the grinding plate is rotatable so as to be turned upside down.

According to the present invention, it is possible to provide a grinding apparatus capable of uniformly grinding an polishing pad, by optimizing the configuration of the device. Furthermore, it is possible to provide a method of grinding an polishing pad by using the grinding apparatus.

DESCRIPTION OF THE PREFERRED EMBODIMENT

Figure 1A:
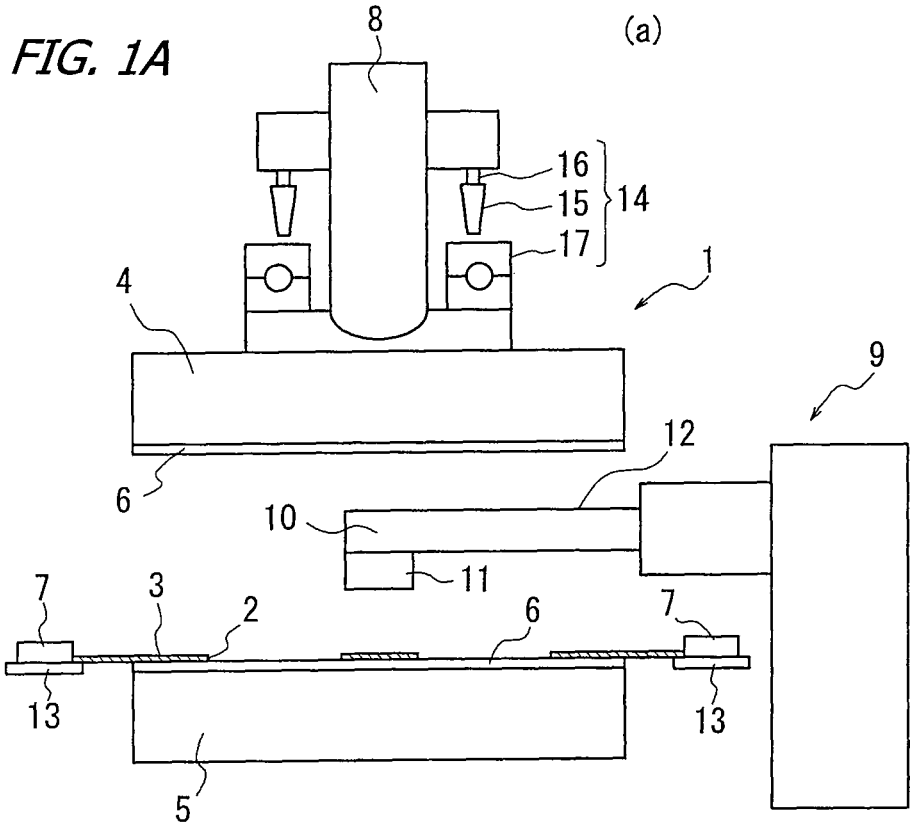
FIG. 1A is a front view of an embodiment of the present invention, in which a grinding apparatus of the present invention is applied to a double-side polishing device.
Figure 1B:
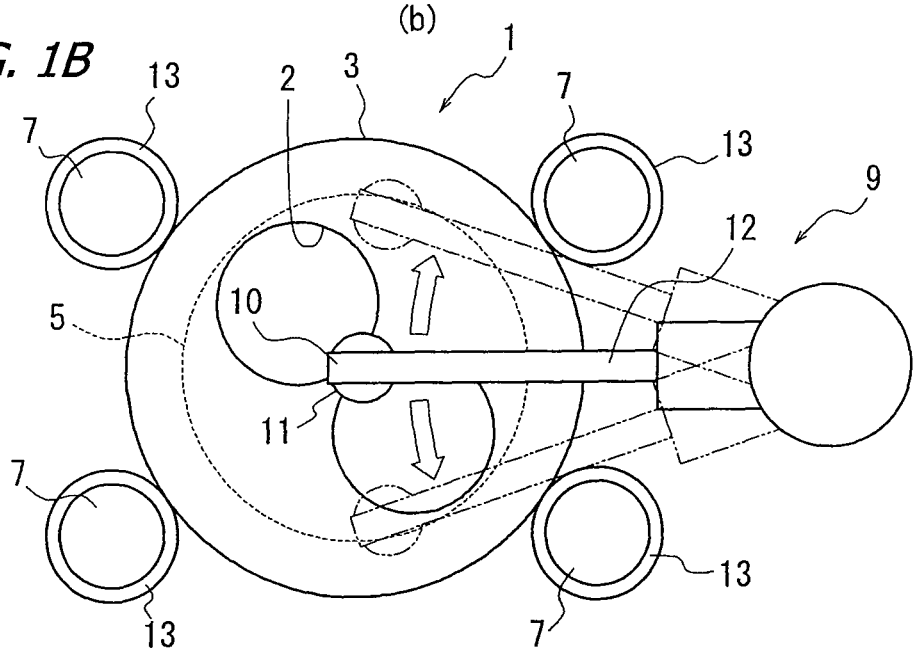
FIG. 1B is a top view of the grinding apparatus of FIG. 1A.

Next, with reference to the drawings, an embodiment of the present invention will be described. FIGS. 1A and 1B are diagrams showing an embodiment in which a grinding (also known as conditioning) apparatus according to the present invention is applied to a double-side polishing device. FIGS. 2-6 are diagrams collectively showing a process of grinding (conditioning) a polishing pad by using the grinding (conditioning) apparatus of the present invention. The term grinding also encompasses polishing and lapping, as well as conditioning.

First, a standard double-side polishing device 1 will be described with reference to FIGS. 1A and 1B. The double-side polishing device 1 includes a carrier 3 having a hole 2 in which a work W is to be fitted, and a pair of upper and lower rotating surface plates 4, 5 disposed to face each other for sandwiching the carrier 3 to polish both sides of a work W. An polishing pad 6 is attached to each of the facing surfaces of the rotating surface plates 4, 5. The polishing pad 6 may be formed by urethane foam or nonwoven cloth. Further, the upper and the lower rotating surface plates 4, 5 are structured to be capable of advancing to/retreating from the carrier 3. The hole 2 of the carrier 3 is disposed right under/above the upper and the lower rotating surface plates 4, 5. Yet further, the carrier 3 is caused to make a circular motion between the upper and the lower rotating surface plates 4, 5 by plural toothed gears 7 which are disposed around the outer periphery of the carrier 3 to gear into teeth provided around the carrier 3. The work W sandwiched between the upper and the lower rotating surface plates 4, 5 is polished by the rotation of the upper and the lower rotating surface plates 4, 5 and the circular motion of the carrier 3. The upper rotating surface plate 4 is coupled with a rotational axis, and the rotational axis has a floating mechanism 8 for causing the upper rotating surface plate 4 to pressingly face a polishing surface of the work W, i.e. for causing the upper rotating surface plate 4 to elastically "float" with respect to the work W in a state that the upper rotating surface plate 4 constantly exerts on the work a pressing force normal to the work surface.

A configuration in which a grinding apparatus 9 according to the present invention is applied to the double-side polishing device 1 as described above will be described hereinafter with reference to FIGS. 1A and 1B. The grinding apparatus 9 according to the present invention is formed by an arm 12 having at a front end portion 10 thereof a disk-shaped grinding plate 11 with a diameter smaller than those of the rotating surface plates 4, 5, and an elevating means 13 for moving the carrier 3 in the vertical direction. A surface of the grinding plate 11 is coated with diamond pellets (diamond particles), of which grain size is #50. In the present embodiment, the carrier 3 is moved up and down by way of the gears 7 which also functions as the elevating means 13. Needless to say, it is possible to employ a structure in which the elevating means 13 capable of vertically moving the carrier 3 is independently provided, separately from the gears 7, rather than to employ a structure in which the gears 7 also function as the elevating means 13. Further, as shown in FIG. 1B, the grinding apparatus 9 according to the present invention is structured such that the grinding plate 11 can be inserted between the separated upper and the lower rotating surface plates 4, 5 by swinging the arm 12, to dispose the grinding plate 11 above the polishing pad 6 (note that the dotted lines shown in FIG. 1B represent examples of movement of the arm 12). Yet further, the upper rotating surface plate 4 is provided with a fixing means 14 for fixing the upper rotating surface plate 4 such that the upper rotating surface plate 4 does not "float" with respect to the work W by the floating mechanism 8. The fixing means 14 is constituted of: an air cylinder 16 having a tapered member 15 at a front end thereof and capable of moving in the vertical direction and pressing the upper rotating surface plate 4 downward by way of the tapered member 15; and a linear motion (LM) guide 17 for allowing the upper rotating surface plate 4 to rotate relative to the floating mechanism.

A process of grinding the polishing pad 6 in the double-side polishing device 1 equipped with the grinding apparatus 9 of the present invention as described above are illustrated in FIGS. 2 to 6. This process will be described in detail hereinafter.

Figure 2:
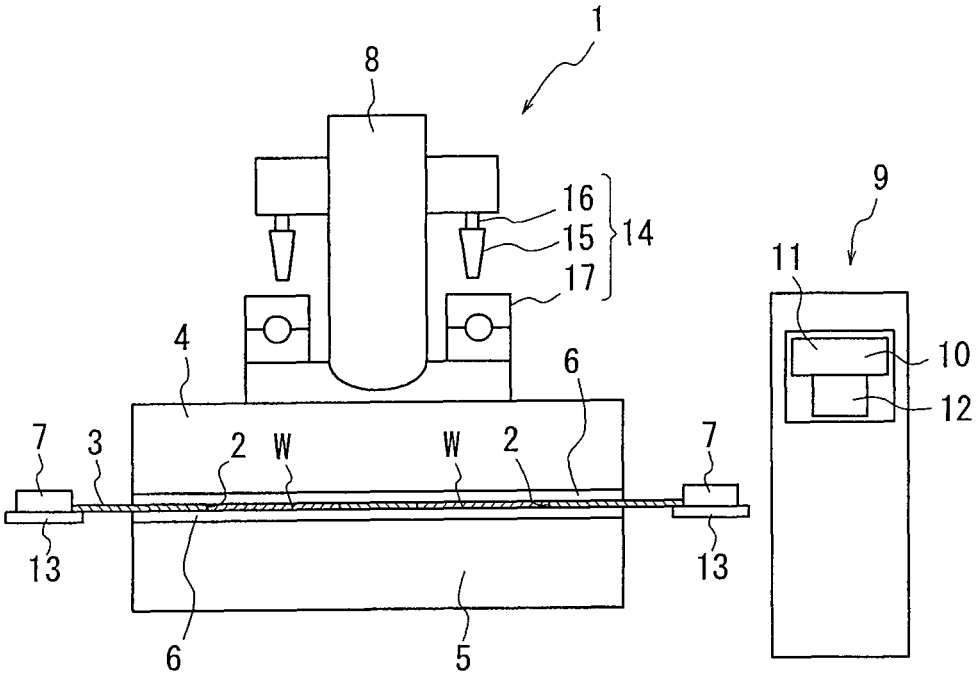
FIG. 2 is a diagram showing a process of grinding an polishing pad by using the grinding apparatus according to the present invention.
Figure 3:
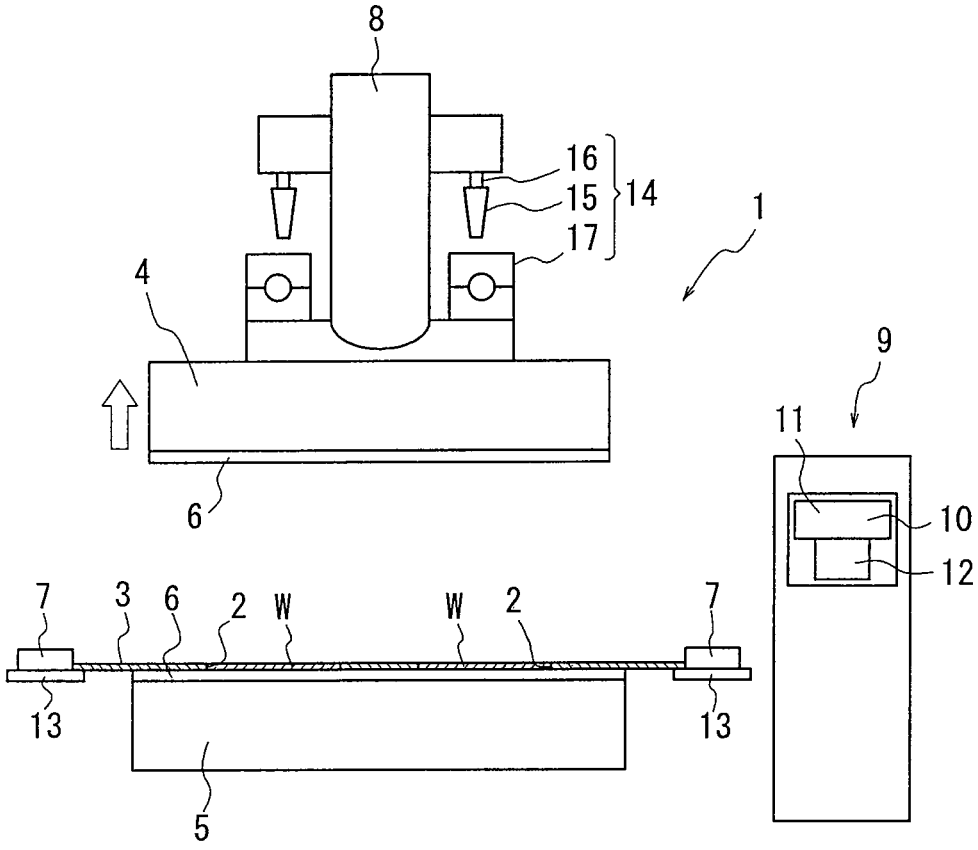
FIG. 3 is another diagram showing the process of grinding an polishing pad by using the grinding apparatus according to the present invention.
Figure 4:
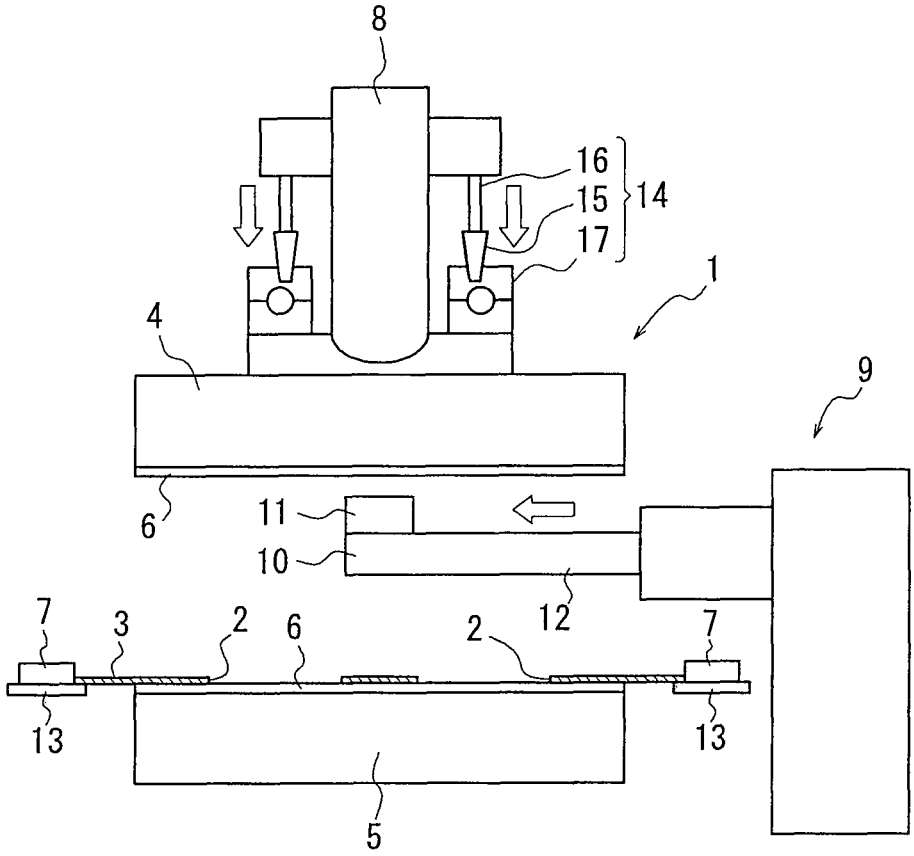
FIG. 4 is yet another diagram showing the process of grinding an polishing pad by using the grinding apparatus according to the present invention.
Figure 5:
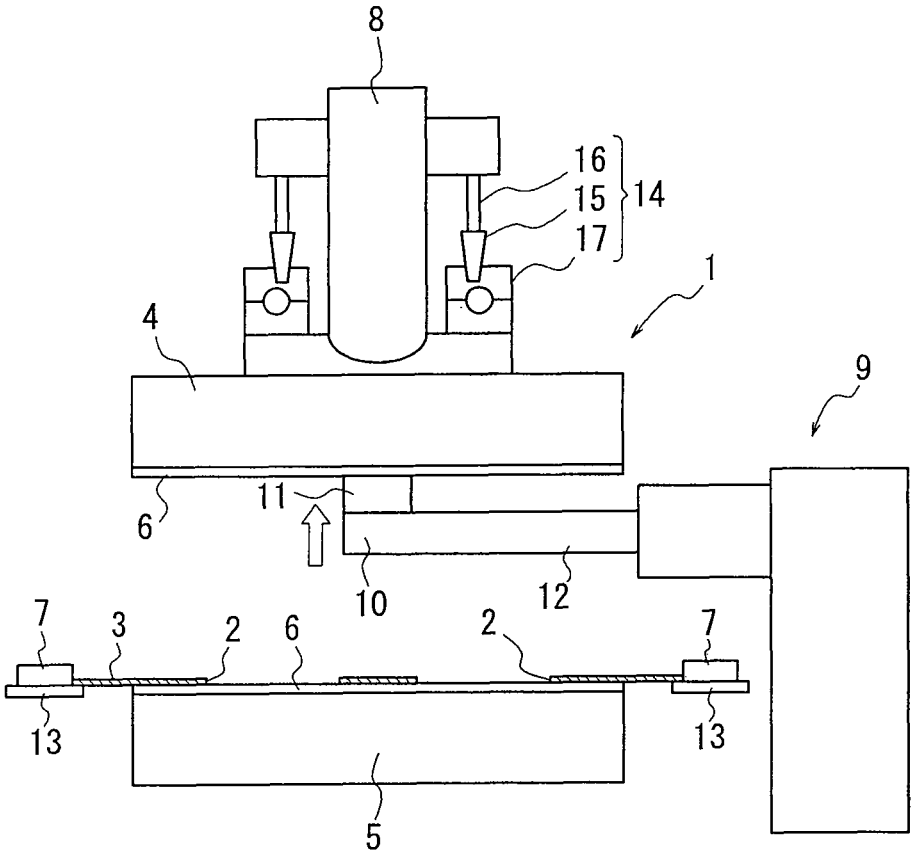
FIG. 5 is yet another diagram showing the process of grinding an polishing pad by using the grinding apparatus according to the present invention.
Figure 6:
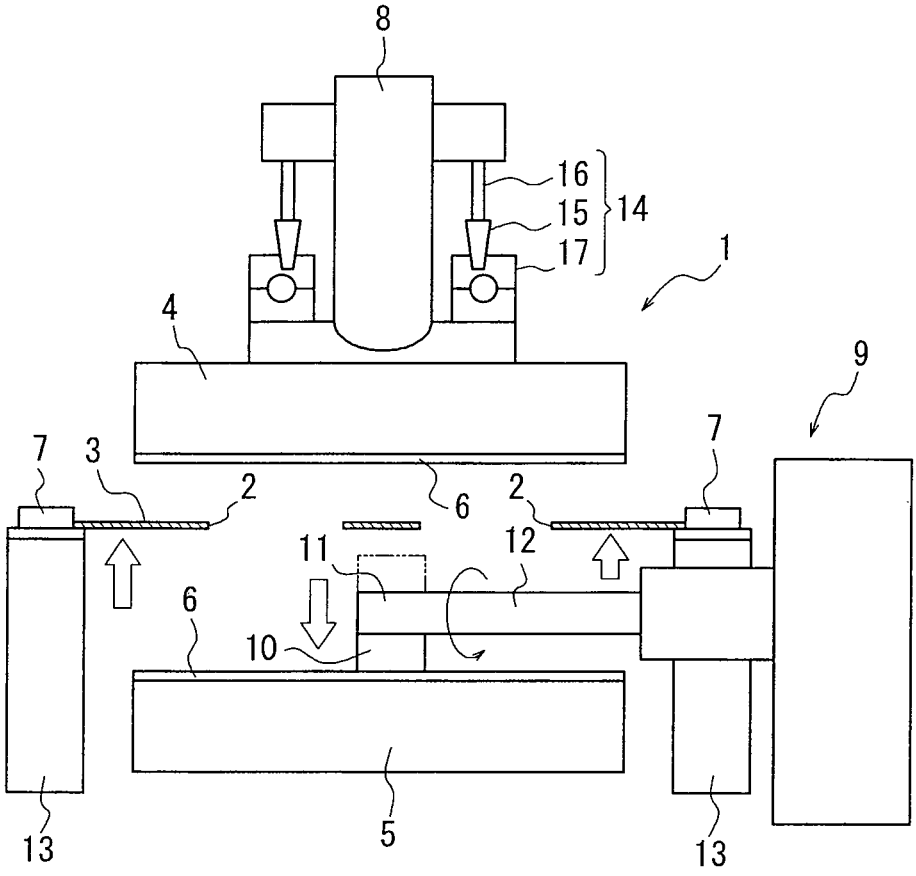
FIG. 6 is yet another diagram showing the process of grinding an polishing pad by using the grinding apparatus according to the present invention.

First, as shown in FIG. 2, the carrier 3 and the work W are being sandwiched between the upper and the lower rotating surface plates 4, 5 immediately after the completion of polishing of the work W by using the double-side polishing device 1. At this stage, the arm 12 is placed at the external side of a side of the carrier 3. Next, the upper rotating surface plate 4 is moved upward so as to be spaced apart from the lower rotating surface plate 5, as shown in FIG. 3. Then, the work W is removed from the hole 2 of the carrier 3 and the grinding plate 11 is inserted between the upper and the lower rotating surface plates 4, 5 by pivoting the arm 12, as shown in FIG. 4. Thereafter, the air cylinder 16 is driven such that each taper member 15 is moved downward and inserted into a hole formed in the LM guide 17, whereby the upper rotating surface plate 4 is pressed downward and fixed. Because of the existence of the LM guide 17, the upper rotating surface plate 4 is rotatable. The grinding plate 11 is then pressed against the upper rotating surface plate 4 and rotated, whereby the polishing pad 6 attached to the upper rotating surface plate 4 is ground, as shown in FIG. 5. During this grinding process by the grinding plate 11, the entire area of the polishing pad 6 is ground by causing the grinding plate 11 to move and make a circular motion on the polishing pad and also rotating the upper rotating surface plate 4. Next, as shown in FIG. 6, the carrier 3 is moved toward the upper rotating surface plate 4 side by using the gears 7 functioning as the elevating means 13, and the arm 12 is caused to perform swinging movement and ascent-descent movement to place itself or the arm 12 below the carrier 3. Further, the arm 12 is rotated around an extending axis of the arm 12 to dispose the grinding plate 11 to face the lower rotating surface plate 5. Thereafter, the grinding plate 11 is pressed against the lower rotating surface plate 5 and rotated, such that the polishing pad 6 attached to the lower rotating surface plate 5 is ground. Then, fluid is sprayed onto the polishing pads 6 to clean the polishing pad. The number of revolution of the upper and the lower rotating surface plates 4, 5, the speed of moving the arm 12 and the rotational rate of the grinding plate 11 are determined in an appropriate manner in accordance with the device structure, from the viewpoint of effectively cleaning the polishing pads 6.

As described above, it is possible to uniformly grind a clogged polishing pad 6, by using the grinding apparatus 9 according to the present invention and controlling the number of revolution of the grinding plate 11 and the speed of moving the grinding plate 11 on the polishing pad 6 in accordance with the degree of clogging of the polishing pad 6. Since the clogged polishing pad 6 can be uniformly ground and regenerated to have improved quality, satisfactory quality of the work W polished by using such an polishing pad 6, which has been subjected to the regenerating process as described above, is also ensured. In a case where the upper rotating surface plate 4 has the floating mechanism 8, there generally exists a possibility that the polishing pad 6 fails to be uniformly ground due to wobbling of the upper rotating surface plate 4 during the grinding. However, in the present invention, the upper rotating surface plate 4 is prevented from wobbling by being fixed by the fixing means 14 and therefore uniform grinding of the polishing pad 6 is effectively ensured, as described above.

Note that the foregoing descriptions illustrate only a part of embodiments of the present invention and it is possible to combine the structures described above with each other and/or apply various modifications thereto without departing from the spirit of the present invention. For example, although the grinding apparatus 9 of the present invention is applied to the double-side polishing device 1 for polishing a single work W in the embodiment described above, the present invention is not limited thereto and it is possible to apply the grinding apparatus 9 of the present invention to a double-side polishing device of multi-carrier-type for effecting double-side polishing of plural works W simultaneously by using plural carriers 3 and then clean the ground polishing pad 6 on the rotating surface plate (not shown). Further, although not shown in drawings, it is possible to provide the front end portion 10 of the arm 12 with, not only the grinding plate 11, but also a nozzle for spraying fluid onto the polishing pad 6 to clean the polishing pad 6.

As is obvious from the description above, according to the present invention, it is possible to provide a grinding apparatus capable of uniformly grinding an polishing pad by optimizing the structure of the device. Furthermore, it is possible to provide a method of grinding an polishing pad by using in the grinding apparatus.

What is claimed is:

1. A method of conditioning polishing pads in a double-side polishing device having a carrier for holding a work, a pair of upper and lower rotating surface plates disposed to face each other to sandwich the carrier therebetween, and a polishing pad provided on each of the facing surfaces of the rotating surface plates for polishing the work, the method comprising the steps of:

separating the upper and the lower rotating surface plates away from each other when the polishing pads on the upper and the lower rotating surface plates are to be conditioned;

inserting, between the separated upper and lower rotating surface plates, an arm that is rotatable about its longitudinal axis, the arm having at a front end portion thereof a conditioning plate rotatably fixed to the arm and having a diameter smaller than those of the rotating surface plates and a rotational axis parallel to that of the upper and lower surface plates;

positioning the arm such that the conditioning plate presses against the polishing pad of one of the rotating surface plates;

rotating the conditioning plate, thereby conditioning the polishing pad of one of the rotating surface plates;

rotating the arm about its longitudinal axis and positioning the arm such the conditioning plate presses against the polishing pad of the other rotating surface plate;

and again rotating the conditioning plate, thereby conditioning the other polishing pad.

2. The method of conditioning a polishing pad of claim 1, further comprising, in a case where the upper rotating surface plate is coupled with a rotational axis having a floating mechanism, first fixing the upper rotating surface plate and then pressing a rough surface of the conditioning plate against the polishing pad of the upper rotating surface plate and rotating the conditioning plate, thereby conditioning the polishing pad of the upper rotating surface plate.

3. The method of conditioning a polishing pad of claim 2, comprising fixing the upper rotating surface plate by fixing means including: an air cylinder capable of moving in the vertical direction and pressing the upper rotating surface plate downward; and a liner motion guide for allowing the upper rotating surface plate to rotate relative to the floating mechanism.

4. The method of conditioning a polishing pad of claim 1, wherein the number of revolutions of the upper and the lower rotating surface plates, the speed of moving the conditioning plate attached to the arm, and the rotational rate of the conditioning plate can be set independently of each other.

5. The method of conditioning a polishing pad of claim 1, further comprising moving the carrier to a position where the carrier does not hinder the conditioning plate in its conditioning of the polishing pad of the lower rotating surface plate.

6. An apparatus for use in a double-side polishing device having a carrier for holding a work, a pair of upper and lower rotating surface plates disposed to face each other to sandwich the carrier therebetween, and a polishing pad provided on each of the facing surfaces of the rotating surface plates for polishing the work, said apparatus being adapted to condition the polishing pads of the upper and lower rotating surface plates, said apparatus comprising:

an arm: having at a front end thereof at least one conditioning plate rotatably fixed to the arm for rotation about an axis parallel to the rotational axes of the upper and lower surface plates, each conditioning plate provided with a rough surface of a diameter smaller than those of the rotating surface plates; and adapted to be capable of advancing/retracting between the upper and the lower rotating surface plates spaced apart from each other, moving upward and downward between the upper and the lower rotating surface plates, and moving to place the conditioning plate on one of the polishing pads such that the conditioning plate conditions the entire area of the polishing pad; and wherein the arm is also rotatable about its longitudinal axis to position the arm such the conditioning plate can press against the polishing pad of the other rotating surface plate and rotate to condition the entire area of the other polishing pad.

7. The apparatus for conditioning a polishing pad of claim 6, wherein the upper rotating surface plate is coupled with a rotational axis having a floating mechanism and the device further comprises a fixing means for fixing the upper rotating surface plate with respect to the floating mechanism.

8. The apparatus of conditioning a polishing pad of claim 7, wherein the fixing means includes: an air cylinder capable of moving in the vertical direction and pressing the upper rotating surface plate downward; and a liner motion guide for allowing the upper rotating surface plate to rotate relative to the floating mechanism.

9. The apparatus for conditioning a polishing pad of claim 7, wherein the conditioning plate is rotatable so as to be turned upside down.

10. The apparatus for conditioning a polishing pad of claim 6, wherein the number of revolutions of the upper and the lower rotating surface plates, the speed of moving the conditioning plate attached to the arm, and the rotational rate of the conditioning plate can be set independently of each other.

11. The apparatus for conditioning a polishing pad of claim 6, wherein the carrier is adapted to be movable to a position where the carrier does not hinder the conditioning plate in its conditioning of the polishing pad of the lower rotating surface plate.

* * * * *